US006520150B1

(12) United States Patent
West

(10) Patent No.: US 6,520,150 B1
(45) Date of Patent: Feb. 18, 2003

(54) FUEL INJECTOR ASSEMBLY AND INTERNAL COMBUSTION ENGINE INCLUDING SAME

(75) Inventor: James Anthony West, Middletown, CT (US)

(73) Assignee: Detroit Diesel Corporation, Detroit, MI (US)

( * ) Notice: Subject to any disclaimer, the term of this patent is extended or adjusted under 35 U.S.C. 154(b) by 0 days.

(21) Appl. No.: 09/642,444

(22) Filed: Aug. 23, 2000

(51) Int. Cl.[7] ..... F02M 37/04
(52) U.S. Cl. ..... 123/446; 123/506
(58) Field of Search ..... 123/446, 447, 123/467, 506; 239/88–96

(56) References Cited

U.S. PATENT DOCUMENTS

| | | | | | |
|---|---|---|---|---|---|
| 1,802,933 | A | | 4/1931 | Salis | |
| 1,843,410 | A | | 2/1932 | Salis | |
| 4,628,881 | A | | 12/1986 | Beck et al. | |
| 5,020,498 | A | | 6/1991 | Linder et al. | |
| 5,036,821 | A | * | 8/1991 | Horiuchi et al. | 123/506 |
| 5,056,488 | A | * | 10/1991 | Eckert | 123/446 |
| 5,058,614 | A | * | 10/1991 | Plohberger et al. | 239/96 |
| 5,277,163 | A | | 1/1994 | Ohishi | |
| 5,441,029 | A | * | 8/1995 | Hlousek | 123/467 |
| 5,443,047 | A | * | 8/1995 | Ishiwata et al. | 123/506 |
| 5,551,398 | A | | 9/1996 | Gibson et al. | |
| 5,622,152 | A | * | 4/1997 | Ishida | 123/446 |
| 5,711,279 | A | * | 1/1998 | Green et al. | 239/96 |
| 5,732,679 | A | * | 3/1998 | Takahasi et al. | 123/467 |
| 5,771,865 | A | * | 6/1998 | Ishida | 123/467 |
| 5,893,350 | A | * | 4/1999 | Timms | 123/467 |
| 6,161,770 | A | * | 12/2000 | Sturman | 239/96 |
| 6,213,093 | B1 | * | 4/2001 | Yudanov et al. | 123/506 |

* cited by examiner

*Primary Examiner*—Thomas N. Moulis
(74) *Attorney, Agent, or Firm*—Brooks & Kushman P.C.

(57) ABSTRACT

A fuel injector assembly is provided which includes a pressurization control valve assembly and a timing control valve assembly. A pressure actuated needle valve is positioned between the pressurization and timing control valves. Pressure within the injector is controlled by opening and closing such valve assemblies. In particular, when the pressurization control valve assembly is open and the timing control valve is closed there will be pressure equilibrium within the injector and a spring will hold the needle valve closed. When the pressurization and timing control valves are both closed, fuel in the injector will be pressurized. Upon opening the timing control valve assembly, there will be a net upward force which will open the needle valve. Closing of the timing control valve assembly will create a net downward force closing the needle valve.

22 Claims, 5 Drawing Sheets

FUEL INJECTOR ASSEMBLY AND INTERNAL COMBUSTION ENGINE INCLUDING SAME

TECHNICAL FIELD

The present invention relates to a fuel injector assembly, and more particularly to an electronic fuel injector assembly which provides electronic control over mean injection pressure, and an internal combustion engine containing such a fuel injector assembly.

BACKGROUND ART

Conventional unit fuel injectors and pump-line-nozzle systems for use with, for example, Diesel engines, have various disadvantages. For example, the pressure during injection is dependent upon engine speed and load and the design of the injection cam lobe. Atomization of the fuel at the beginning of injection is often a function of a mechanical spring. Therefore, the quality of the atomization is a function of the reliability of the spring which may vary over time. In addition, the control of pressure at the beginning of injection is limited to the pre-load of the spring. Further, the flexibility of conventional unit injectors and pump-line-nozzle systems is limited to the extent that typically they do not include means to control pressure at the beginning of injection. In addition, conventional unit injectors and pump-line-nozzle systems typically require that the pressure be reduced in order to end injection. Such a reduction in pressure adversely affects the nature of fuel atomization which tends to increase particulate emission levels. Another disadvantage is that the speed with which conventional unit injectors and pump-line-nozzle systems operate when multiple injections are provided in a single engine cycle is limited due to the need to build pressure for each individual injection event during each single engine cycle. One drawback when using conventional common rail systems is that pressure waves from one injector tend to be "seen" by other injectors. This can lead to cylinder-to-cylinder variations as each injector is supplied with varying rail pressures. In addition, the injection pressure of conventional common rail systems is limited to about 1400 bar (20,400 p.s.i.). Such a pressure limitation limits fuel economy at high engine speeds and loads. Further, safety is always a concern when using high pressure. For example, in conventional common rail systems, the possibility that external high pressure lines and fittings may leak or rupture is always a concern. Similarly, the length of time that pressurized fuel is present at the needle tip is a concern since the tip may fail resulting in excessive fueling at the cylinder.

DISCLOSURE OF THE INVENTION

An object of the present invention is to provide a fuel injector assembly which combines advantages of a unit injector with those of a common rail fuel system.

Yet a further object of the present invention is to provide a fuel injection assembly which combines advantages of a unit injector and a common rail fuel system in one compact package.

Another object of the present invention is to provide a fuel injector assembly which combines peak injection pressure and injection rate shape of a unit injector with the mean injection pressure control of a common rail system over all engine speeds and loads.

A further object of the present invention is to provide a fuel injector assembly which provides quick pilot injection response and good atomization characteristics at the beginning and ending of injection found in a common rail system.

Yet another object of the present invention is to provide a fuel injector assembly which does not present the safety concerns of a conventional continuously pressurized needle.

Another object of the present invention is to provide a fuel injection assembly which eliminates the need for external high pressure lines or fittings that may rupture or leak.

A further object of the present invention is to provide a fuel injector assembly wherein the control of fuel pressure at the beginning of injection is not dependent upon engine speed and load.

Yet another object of the present invention is to provide a fuel injector assembly wherein the beginning of injection pressure may be controlled.

Another object of the present invention is to provide a fuel injector assembly wherein fuel pressure at the end of injection does not need to be reduced.

Yet a further object of the present invention is to provide a fuel injector assembly wherein the response during multiple injections during a single engine cycle is considerably faster than heretofore.

A further object of the present inventions is to provide a fuel injector assembly which eliminates cylinder-to-cylinder pressure variations.

Another object of the present invention is to provide a fuel injector assembly which increases fuel economy at high engine speeds and loads.

Still a further object of the present invention is to provide an internal combustion engine which includes a fuel injector assembly which achieves one or more of the foregoing objects.

This invention achieves these and other objects by providing a fuel injector assembly, comprising a pressurization control valve assembly, a timing control valve assembly and a pressure actuated needle valve. The pressure actuated needle valve provides a fuel outlet and a spring biased needle structured and arranged to be moved to an open position and a closed position relative to the fuel outlet and being positioned between the pressurization control valve assembly and the timing control valve assembly. Means are provided for selectively opening and closing the pressurization control valve assembly and the timing control valve assembly to control the pressure within the pressure actuated needle valve such that (a) when the pressurization control valve assembly is open and the timing control valve assembly is closed there will be pressure equilibrium within the pressure actuated needle valve and the spring will hold the needle in the closed position; (b) when the pressurization control valve assembly and timing control valve assembly are both closed, fuel in the pressure actuated needle valve will be pressurized, there will be pressure equilibrium within the pressure actuated needle valve, and the spring will continue to hold the needle in the closed position; (c) upon opening the timing control valve assembly, there will be a net force which will urge the needle in the open position; and (d) upon closing of the timing control valve assembly will there be a net force which will urge the needle in the closed postion.

This invention also achieves these and other objects by providing a fuel injector assembly which comprises a fuel injector housing comprising a plunger cavity and a first fuel chamber. A pressurization control valve assembly is provided which is structured and arranged for electrical connection to an electronic control module. The pressurization control valve assembly comprises a second fuel chamber, in fluidic communication with the first fuel chamber, and a first valve member and a second valve member. The first valve member is operable to open and close fuel flow between the first fuel chamber and the second fuel chamber in response to electronic control module signals. A control rod housing is provided which comprises a first pressure chamber, in fluidic communication with the plunger cavity, and a control rod cavity. A timing control valve assembly is provided which is structured and arranged for electrical connecion to an electronic control module and comprises a third valve member. A spill circuit conduit is provided which is in fluidic communication with the timing control valve assembly. A first fuel conduit extends between the first pressure chamber and the timing control valve assembly, the third valve member being operable to open and close fuel flow between the first fuel conduit and the spill circuit conduit in response to electronic control module signals. A needle assembly housing is provided which comprises a second pressure chamber, a needle cavity and a fuel outlet, the needle cavity comprising a first segment adjacent the control-rod cavity and a second segment in fluidic communication with the fuel outlet and the second pressure chamber. A second fuel conduit extends between the plunger cavity and the second pressure chamber. A plunger extends into the plunger cavity and is structured and arranged for reciprocating movement within the plunger cavity. An actuator is associated with the plunger and is structured and arranged for reciprocating the plunger in the plunger cavity. A control rod extends into the control rod cavity and includes a control rod segment, extending into the first segment of the needle cavity, and a control surface exposed to the first pressure chamber. The control rod is structured and arranged for reciprocating movement within the control rod cavity. A needle is provided having a first end extending into the first segment of the needle cavity, the first end including a first abutment surface engaging the control rod segment, and an opposite second end extending into the second segment of the needle cavity. The second end comprises a needle portion exposed to the second pressure chamber. The needle is structured and arranged for reciprocating movement within the needle cavity to open and close the fuel outlet. A third fuel conduit extends between the plunger cavity and the first fuel chamber, and a fourth fuel conduit extends between the second fuel chamber and a fuel supply conduit. A fifth fuel conduit extends between the first fuel chamber and the spill circuit conduit, the second valve member being operable to open and close fuel flow between the first fuel chamber and the spill circuit, when the first valve member is closed and opened, respectively.

An internal combustion engine which includes at least one piston which reciprocates within an engine cylinder and which includes a fuel injector assembly of the present invention is also provided.

BRIEF DESCRIPTION OF THE DRAWINGS

This invention may be clearly understood by reference to the attached drawings wherein like elements are described by like reference numerals and in which.

DESCRIPTION OF THE PREFERRED EMBODIMENT

For a better understanding of the present invention, together with other and further objects, advantages and capabilities thereof, reference is made to the following disclosure and appended claims taken in conjunction with the above-described drawings.

FIGS. 1 to 4 illustrate one embodiment of the present invention. FIGS. 1 to 4 illustrate a fuel injector assembly or unit 10. When combined with an internal combustion engine such as, for example, a Diesel engine, a plurality of individual fuel injector assemblies 10 will be provided. In such an embodiment, the internal combustion engine will include at least one piston which reciprocates within a respective engine cylinder into which a fuel injector assembly 10 extends in a conventional manner. Each unit will be associated with the same common fuel supply and yet will be isolated from all of the other units.

Figure 1:
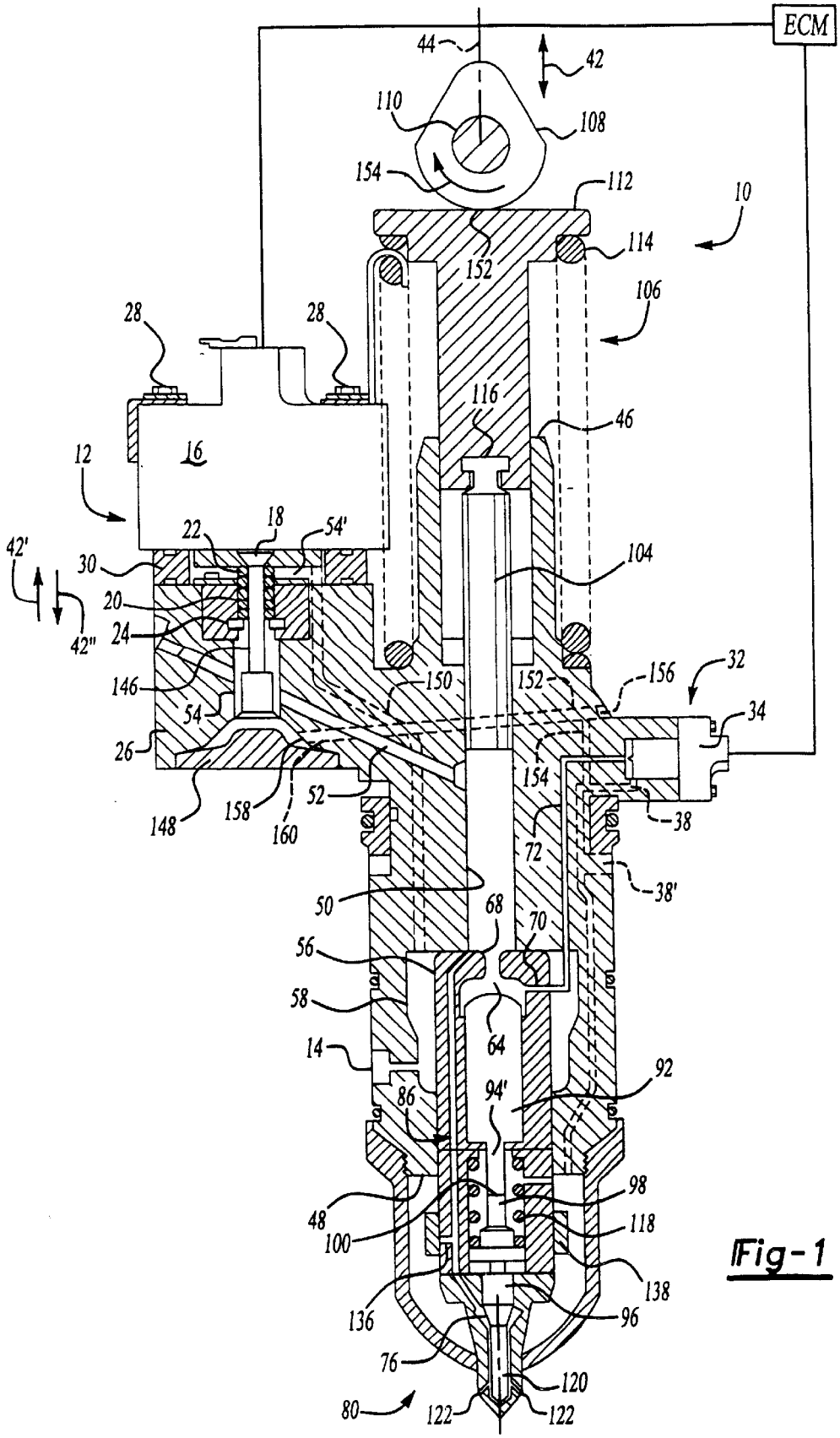
FIG. 1 is a partial cross sectional view of one embodiment of the fuel injector assembly of the present invention illustrative of one stage of operation thereof.

Fuel injector assembly 10 comprises a pressurization control valve assembly 12 structured and arranged for electrical connection to an electronic control module designated as ECM. The pressurization control valve assembly is connected to a common rail fuel system (not shown) at a fuel inlet provided at fuel supply conduit 14. Without limitation, valve assembly 12 is a conventional 3-2 mechanical pressurization control valve assembly. In one alternative embodiment, pressurization control valve assembly 12 could be an electronically actuated pressure control valve assembly. Pressurization control valve assembly 12 comprises a solenoid 16 including a valve member 18. Valve member 18 is biased to an open position by a compression spring 20 as illustrated in FIG. 1. Spring 20 extends between a spring cap 22 of the valve member 18 and a plate 24 attached to a fuel injector housing 26 of a fuel injection housing assembly. The pressurization control valve assembly 12 is attached to the fuel injector housing 26 by bolts 28 which extend through the housing of the solenoid 16 and a gasket 30, and are threaded into the housing 26. In viewing FIG. 4, when the solenoid 16 is energized the valve member 18 is urged upwardly (42') by the solenoid 16 to a closed position. In viewing FIGS. 1 and 2, when the solenoid is deenergized the spring 20 urges the valve member downwardly (42") to an open position.

Fuel injector assembly 10 comprises a timing control valve assembly 32 structured and arranged for connection to an internal spill circuit as described herein. Without limitation, valve 32 is a two-way valve which allows fuel to spill from the injector to the spill circuit as described herein. With reference to enlarged FIG. 3, the timing control valve assembly 32 comprises a solenoid 34 to which a valve member 36 is coupled in a conventional manner. The valve assembly 32 is connected to the internal spill circuit through a spill circuit conduit 38 which communicates with a spill orifice 38'. Spill circuit conduit 38 is illustrated in phantom lines for clarity. Spill circuit conduit 38 and the other fuel circuits referred to herein may be formed by bores within the housings and other components referred to. The timing control valve assembly 32 is attached to the fuel injector housing 26 by bolts 40 which extend through the housing of the solenoid 34 and are threaded into the housing 26.

Fuel injector housing 26 extends in the direction 42 of a longitudinal axis 44 from an end 46 to an opposite end 48.

The housing 26 comprises a plunger cavity 50 which extends in direction 42. A fuel conduit 52 communicates between the plunger cavity 50 and a fuel chamber 54 of the pressurization control valve assembly 12.

Figure 3:
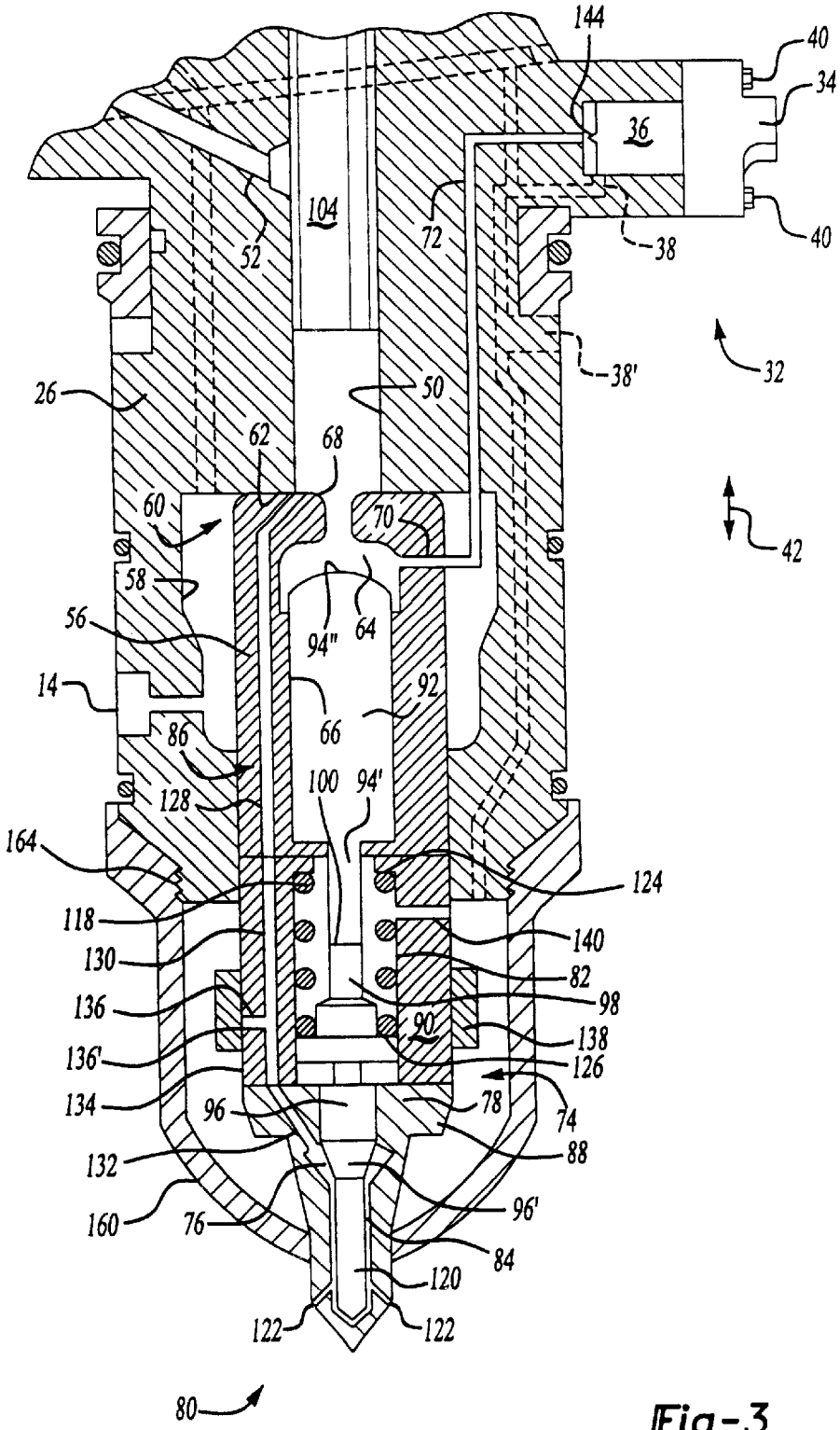
FIG. 3 is an enlargement of a portion of FIG. 2.

A control rod housing is coupled to the fuel injector housing. With reference to FIG. 3, a control rod housing 56 extends within a control rod housing cavity 58 of the fuel injector housing 26. The control rod housing 56 extends in direction 42 and includes an end 60 which engages a surface 62 of housing cavity 58. Control rod housing 56 is contained within housing cavity 58 and urged against surface 62 as described hereinafter. Control rod housing 56 comprises a first pressure chamber 64 and a control rod cavity 66. Pressure chamber 64 communicates with plunger cavity 50 through a first orifice 68 which extends through the control rod housing 56. The orifice 68 controls the rate of flow of the fuel between the plunger cavity 50 and the first pressure chamber 64. The control rod housing 56 includes a fuel conduit 70 which extends through the control rod housing 56 to the pressure chamber 64. Fuel injector housing 26 comprises another fuel, conduit which communicates between the first pressure chamber 64 and the timing control valve assembly 32. In particular, a fuel conduit 72 extends within the housing 26 from fuel conduit 70 to the valve mechanism 36.

The fuel injector assembly 10 comprises a needle assembly housing 74 coupled to the fuel injector housing 26. The needle assembly housing 74 comprises a second pressure chamber 76, a needle cavity 78 and a fuel outlet 80. Needle cavity 78 comprises a first segment 82 adjacent the control rod cavity 66 and a second segment 84 extending from the segment 82 to the fuel outlet 80. A fuel conduit 86 is provided between the plunger cavity 50 and the second pressure chamber 76.

In the embodiment illustrated in FIGS. 1 to 4, the needle assembly housing 74 comprises a needle tip housing 88 and a spring cage 90. Spring cage 90 is positioned between the control rod housing 56 and the needle tip housing 88. The needle tip housing 88 comprises the second segment 84 of the needle cavity 78, including the second pressure chamber 76. The spring cage 90 comprises the first segment 82 of the needle cavity 78.

A control member in the form of a control rod 92 extends in direction 42 in the control rod cavity 66. With particular reference to FIG. 3, the control rod 92 includes at one end an elongated control rod segment 94', which extends into the first segment 82 of the needle cavity 78, and at an opposite end a surface 94" which is structured and arranged so as to provide a surface which is exposed to downwardly directed pressure in the first pressure chamber 64. Without limitation, surface 94" is convex towards the orifice 68. A needle 96 is provided within the needle cavity 78. The area of the surface 94" is greater than the area of a portion 96' of the needle 96. Porion 96' is structured and arranged so as to provide a surface which is exposed to upwardly directed pressure in the second pressure chamber 76. Without limitation, surface 96' is in the form of a truncated conical portion converging downwardly. The control rod 92 is disposed within cavity 66 for reciprocating movement in direction 42 as described hereinafter.

As illustrated in FIG. 3, needle 96 includes a first end 98 which extends into the first segment 82 of the needle cavity 78. The first end 98 includes a first abutment surface 100 which engages the distal end of control rod segment 94'. Needle 96 includes an opposite second end 102 which extends into the second segment 84 of the needle cavity 78. Needle 96 is disposed within the needle cavity 78 for reciprocating movement in direction 42 within the needle cavity to open and close the fuel outlet 80 as described hereinafter.

Figure 2:
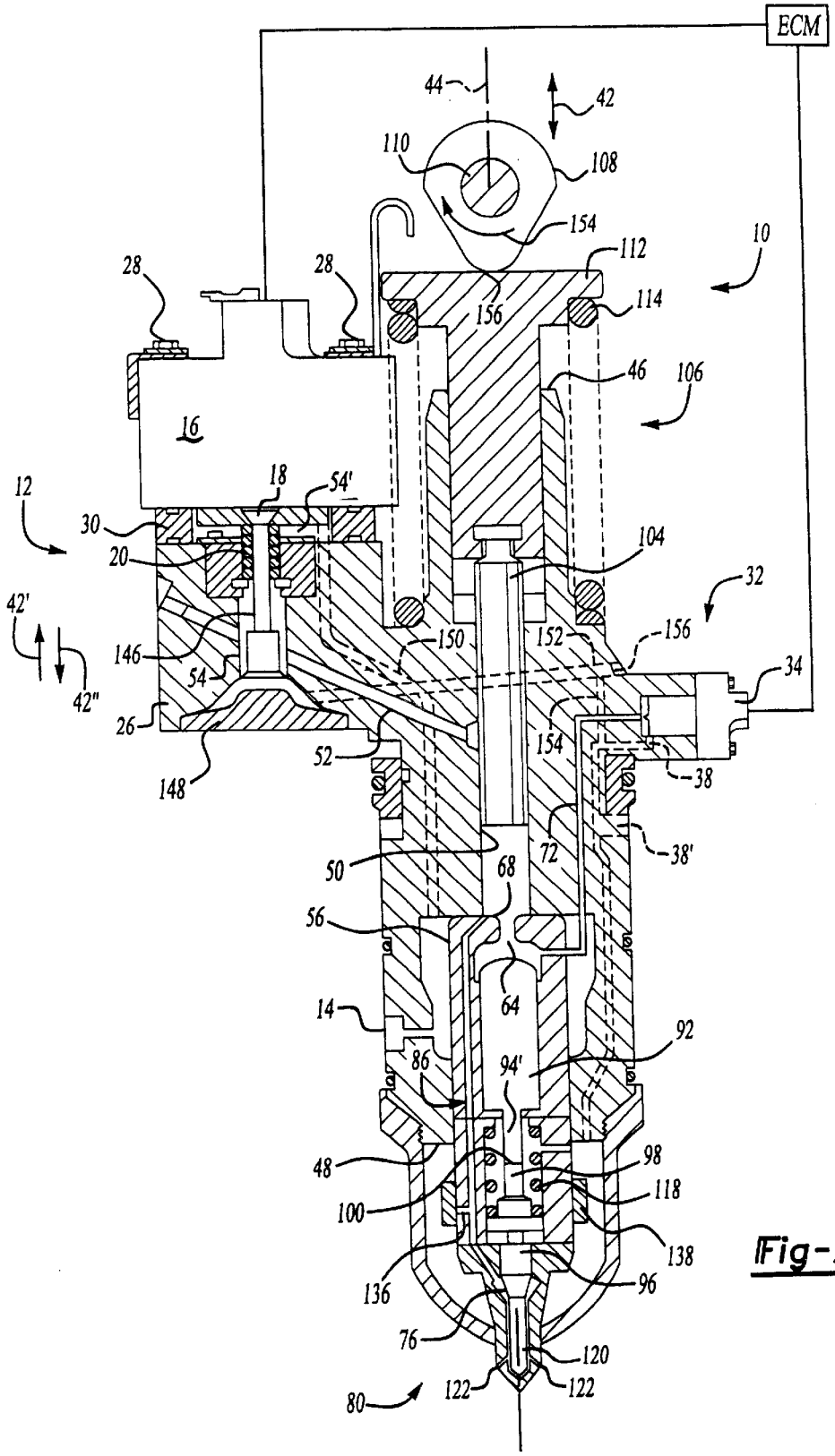
FIG. 2 is illustrative of another stage of operation of the fuel injector assembly of FIG. 1.
Figure 4:
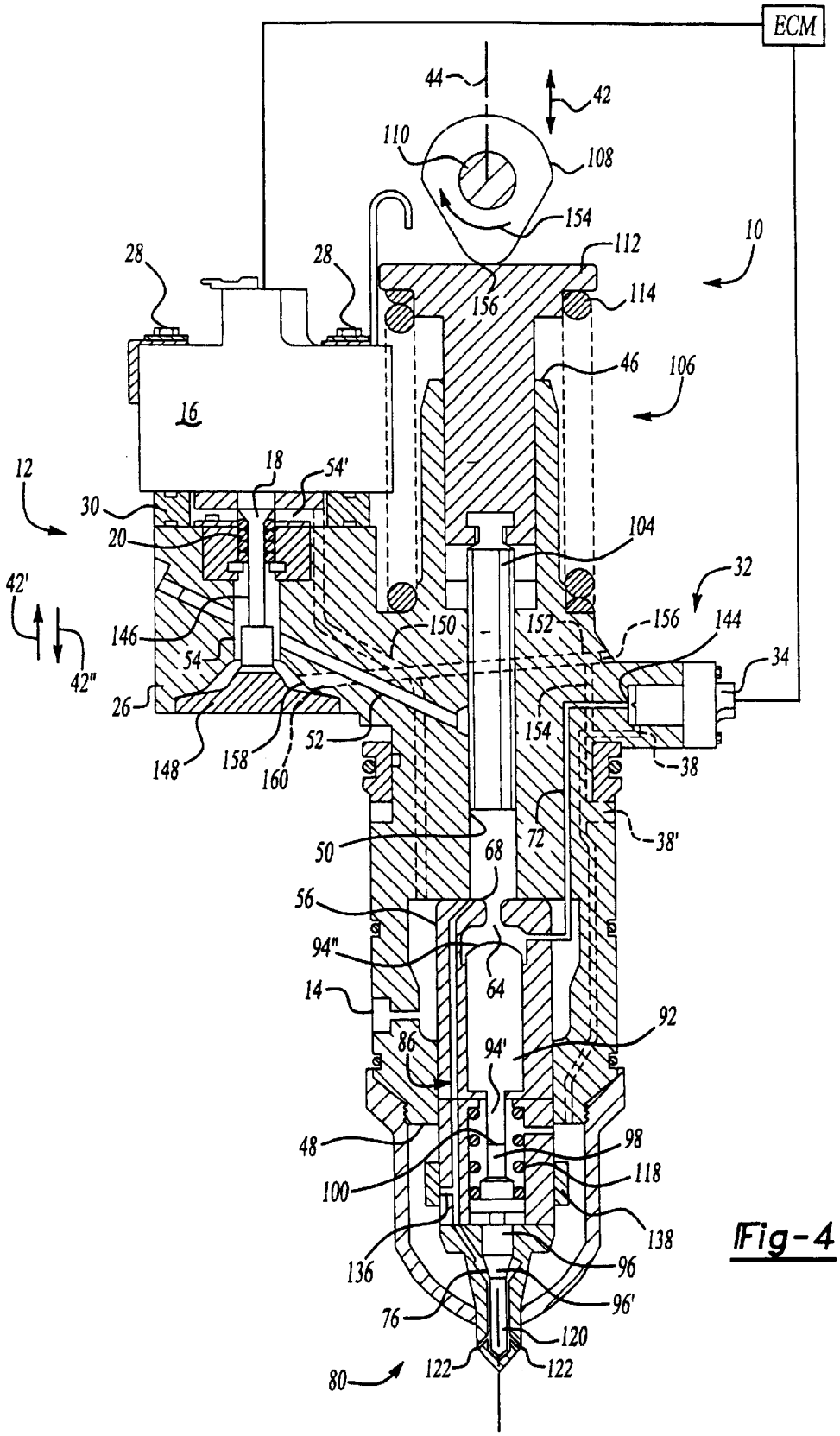
FIG. 4 is illustrative of yet another stage of operation of the fuel injector assembly of FIG. 1.

The fuel injector assembly 10 comprises a plunger 104 which extends into the plunger cavity 50. Plunger 104 is disposed for reciprocating movement in direction 42 within the cavity 50 as described hereinafter. To this end an actuator 106, illustrated in FIGS. 1, 2 and 4 is associated with the plunger 104. Actuator 106 is a conventional cam shaft assembly which comprises a conventional cam 108, a cam shaft 110, a cam follower 112 and a spring 114. Rotation of the cam 108 by the shaft 110 causes the cam follower 112, and plunger 104 attached thereto at 116, to be urged towards the fuel outlet 80 as the cam rotates towards its high point. The spring 114 urges the cam follower 112 and plunger 104 away from the fuel outlet 80 as the cam 108 rotates towards its low point. The camshaft assembly illustrated in FIGS. 1, 2 and 4 is by way of example. Any other actuator may be provided to cause the plunger 104 to reciprocate within plunger cavity 50 as described herein. For example, and without limitation, the plunger may be driven by a solenoid, a push rod/rocker arm combination, a rocker arm and the like.

With reference to FIG. 3, the needle assembly housing 74 forms a needle valve which comprises a spring 118 which biases the needle 96 towards the fuel outlet 80. The tip 120 of the needle 96 is structured and arranged such that (a) when the needle 96 is in a closed mode the tip 120 will cover the apertures 122 which form the fuel outlet 80 thereby preventing fuel from flowing through such apertures, and (b) when the needle 96 is in an open mode the tip 120 will be moved away from apertures 122 thereby allowing fuel to flow through such apertures into the engine combustion chamber of the cylinder, as described hereinafter. For purposes of clarity, in the drawings the tip 120 of needle 96 is illustrated as being slightly spaced from the inner surface of the needle tip housing 88. In the actual embodiment, the tip 120 will sufficiently contact the inner surface of the needle tip housing 88 in a conventional manner to close apertures 122 and prevent injection of fuel at the fuel outlet 80 in the closed mode. In the embodiment illustrated in the drawings, the spring 118 is sized to apply only enough force to hold the needle 96 in a closed position relative to apertures 122 against the pressure of combustion gases. As a practical matter, the spring 118 serves to hold the needle in a closed position only when the needle is not in operation. The spring 118 is positioned within the first segment 82 of the needle cavity 78 between an inner surface 124 of the spring cage 90 and a second abutment surface 126 of the needle 96. The second abutment surface 126 is positioned between the first abutment surface 100 and the end 102 of the needle 96.

With reference to FIG. 3, the fuel conduit 86 comprises a first length 128, a second length 130 and a third length 132. Length 128 extends through the control rod housing 56 from the plunger cavity 50 to the spring cage 90. Length 130 extends through the spring cage 90 from the length 128 to the needle tip housing 88. Length 132 extends through the needle tip housing 88 from the length 130 to the second pressure chamber 76.

In the embodiment illustrated in FIGS. 1 to 4, the fuel injector assembly 10 comprises a waste gate. To this end, and with reference to FIG. 3, the spring cage 90 includes a generally cylindrical outer peripheral surface 134. A fuel conduit 136 is provided which extends through the spring cage 90 from the length 130 of the fuel conduit 86 to outer peripheral surface 134. Conduit 136 communicates with the spill circuit through spill circuit conduit 38. A waste gate in the form of a cylindrical collar 138 surrounds the spring cage 90 at its outer peripheral surface 134 thereby covering the fuel conduit 136. Collar 138 is expandable under pressure as described herein. In the embodiment illustrated in the drawings, the spring cage 90 includes a fuel venting conduit 140 which extends through the spring cage to vent to the spill circuit any fuel which leaks into the first needle segment 82 of the needle cavity 78. To this end, conduit 140 communicates with spill orifice 38' through spill circuit conduit 38.

With reference to FIG. 3, an orifice 144 is provided at the timing control valve assembly 32 between the fuel conduit 72 and the valve mechanism 36 to control the rate of flow of the fuel between the pressure chamber 64 and the valve mechanism 36. The orifices 68 and 144 are structured and arranged such that during operation of the fuel injector assembly as described hereinafter, the rate of flow of fuel through orifice 144 will be greater than the rate of flow of fuel through orifice 68.

When the solenoid 16 is deenergized, the compression spring 20 urges the valve member 18 in direction 42" (FIGS. 1 and 2), and when the solenoid is energized it urges the valve member 18 in opposite direction 42' (FIG. 4). Fuel conduits 150, 152 and 154, illustrated in phantom lines for clarity, are provided within the fuel injector housing 26. Conduit 150 extends between a fuel chamber 54' of the pressurization control valve assembly 12 and the housing cavity 58. In this manner, the fuel chamber 54' communicates with the fuel conduit 14 which also communicates with the housing cavity 58. Conduit 152 extends between the fuel chamber 54 of the fuel injector housing 26 and a plug 156. Fuel conduit 154 extends between fuel conduit 152 and spill circuit conduit 38. Fuel chambers 54 and 54' are in fluidic communication, and the valve member 18 is operable as described herein to open and close fuel flow between fuel chambers 54 and 54' in response to signals from the ECM. The valve member 18 and the fuel conduit 152 are structured and arranged such that when the ECM deenergizes the solenoid 16, the compression spring 20 urges the valve member 18 in direction 42" so that a surface 158 of the valve member 18 opens the conduit 152 to allow fuel flow between the fuel chamber 54 and the spill circuit conduit 38 (FIGS. 1 and 2). When the ECM energizes the solenoid 16, the solenoid urges the valve member 18 in direction 42' so that surface 158 closes the conduit 152 at end 160 to close fuel flow between the fuel chamber 54 and the spill circuit conduit 38.

With reference to FIG. 3, the control rod housing 56, spring cage 90 and needle tip housing 88 are held in place relative to the fuel injector housing 26 by a bell-shaped cap nut 162 threaded to the fuel injector housing at 164.

Without limitation, the fuel injector assembly 10 illustrated in FIGS. 1 to 4 is fabricated from metallic components. Alternatively, the assembly 10 may comprise, for example, a control rod 92 and needle 96 in the form of ceramic monoliths. The use of ceramic monoliths will reduce the inertia of the control rod 92 and needle 96 as they are reciprocated in direction 42 thereby reducing the time required to open and close the needle valve. In this manner, it is possible to reduce the time between multiple injection events.

Operation

There follows a description of the operation of the embodiment of the fuel injector assembly of the present invention illustrated in FIGS. 1 to 4. In considering such description, it will be noted that the 3-2 valve assembly 12 controls the beginning of the pressurization of the fuel injector assembly 10, and the 2-2 valve assembly 32 controls the beginning of injection and end of injection. The waste gate 138 limits the injection pressure to a set quantity across all speeds. When the injection pressure exceeds such limit, the force exerted by the fuel as it flows through conduit 136 causes the collar 138 to expand releasing the fuel so that it flows through the conduit 38 and the spill orifice 38', and returns to the internal spill circuit. Energization and deenergization of the solenoids 16 and 34 of respective valve assembly 12 and valve assembly 32 may be effected as desired by a conventional electronic control module to which such valve assemblies are electrically connected in a conventional manner. Camshaft 110/cam 108 is caused to rotate in a conventional manner. A conventional fuel line (not shown) connected to a common rail fuel system is connected to the fuel injector assembly 10 at the fuel supply conduit 14.

Stage 1 (FIG. 1)

During the operation of the fuel injector assembly 10, the plunger 104 will not be stationary during most of the injection event. In Stage 1, cam 108 has been rotated in direction 154 so that the low point 152 of the cam engages the cam follower 112, and plunger 104 has been urged upwardly as a result of the spring 114 being biased upwardly against the cam follower 112 to which the plunger is attached at 116. The solenoid 16 has been deenergized causing the spring 20 to urge the valve member 18 downwardly in direction 42" to open valve member 18. During Stage 1, the fuel supply conduit 14 is in communication with plunger cavity 50 through conduit 150, chambers 54', 54 and conduit 52. The timing control valve assembly 32 is in a closed mode. Fuel is supplied to fuel supply conduit 14 at low pressure of about 50 to 70 p.s.i. in a conventional manner. Such fuel passes through conduit 150, the fuel chambers 54' and 54 and the conduit 52, into plunger cavity 50. Fuel passes from cavity 50 through orifice 68 and into first pressure chamber 64 and fuel conduits 70 and 72. The fuel also fills fuel conduit 86, and flows to the waste gate at fuel conduit 136 and the second pressure chamber 76. At this stage, the pressure of the fuel in pressure chambers 64 and 76 will be equal, and the control rod segment 94' will engage the abutment surface 100 of the end 98 of the needle 96. In essence, the control rod 92 and the needle 96 will be connected hydraulically, the equalized pressure in pressure chambers 64 and 76 forcing the two parts together. The spring 118 will hold the needle in a closed position such that the tip 120 of the needle 96 closes the apertures 122 of the fuel outlet 80.

Stage 2 (FIG. 2)

With the valve member 18 of the pressurization control valve 12 remaining open, the timing control valve assembly 32 remaining closed, and the cam 108 continuing to rotate in direction 154, the cam urges the cam follower 112 and plunger 104 downwardly against the tension in the spring 114 as the high point 156 of the cam engages the cam follower 112. During such downward movement, the plunger 104 passes through the fuel filled plunger cavity 50 displacing fuel back through the conduit 52, fuel chambers 54', 54, conduit 150 and back into the fuel supply line connected to fuel supply conduit 14. Displacement of the fuel out of cavity 50 in this manner prevents any pressure change in pressure chambers 64 and 76. Therefore, the spring 118 continues to hold the needle 96 in a closed position. The cam 108 and cam shaft 110 will continue to rotate in direction 154 causing plunger 104 to continue to reciprocate under the action of the cam 108 (downstroke) and spring 114 (upstroke).

Stage 3 (FIG. 4)

During the pressurization/injection cycle, Stage 2 is omitted and Stage 3 is implemented. In particular, after fuel has been injected into the injector as described under Stage 1, the electronic control module causes the solenoid 16 to be energized and urge the valve member 18 upwardly to close valve 18. The timing control valve assembly 32 remains in a closed mode. With the valve member 18 and timing control valve assembly 32 closed, the fuel supplied to the various cavities of the fuel injector during Stage 1 is trapped in the fuel injector. Cam 108 continues to rotate in direction 154 during Stage 3 causing the high point 156 to approach the cam follower 112 to urge the cam follower and plunger 104 downwardly. Until such time as the plunger 104 has been urged downwardly in direction 42", continued downward movement of plunger 104 causes the pressure of the fuel within the injector to increase since there is nowhere for the fuel to go. As the cam 108 continues to rotate the plunger 104 continues to move downward, and the pressure builds up within the control rod housing 56 and the needle assembly housing 74. Opposing forces are exerted on the surface 94" of the control rod 92 and the surface 96' of the needle 96 in pressure chambers 64 and 76, respectively. Due to the fact that the area of the surface 94" is larger than the area of the surface 96', and the pressure within the injector is uniform, the net force is downward. Such downward force holds the needle 96 in a closed position so that the needle tip 122 continues to close the apertures 122 of the fuel outlet 80.

To effect fuel injection at fuel outlet 80, the electronic control module causes the timing control valve assembly 32 to be opened which allows the fuel in the pressure chamber 64 to escape by flowing through fuel conduit 72 and the orifice 144 of the timing control valve assembly, the fuel then flowing from the valve assembly 32 through fuel conduit 38 and the spill orifice 38', and returning to the internal spill circuit. The escape of fuel in this manner reduces the pressure exerted by the fuel on the surface 94" of the control rod 92. Since the pressure acting on the needle 96 at surface 96' has not changed, and the pressure acting on the surface 94" of the control rod 92 has been reduced, the net force will be upward in direction 42". Such upward force will be greater than the force of the spring 118 urging the needle 96 in direction 42", the net effect pushing the needle and control rod upwardly in direction 42'. The result will be that the needle tip 120 will be moved away from apertures 122 thereby allowing injection of fuel to begin at the fuel outlet 80 through apertures 122. When the desired quantity of fuel has been injected, the electronic control module causes the timing control valve assembly 32 to be closed to stop further flow of fuel out of the pressure chamber 64. As cam 108 continues to rotate in direction 154 and the plunger 104 continues to move downwardly fuel will rapidly refill the pressure chamber 64 through orifice 68, and pressure exerted against surface 94" of control rod 92 will again build up sufficiently to force the control rod and needle 96 downwardly so that needle tip 120 closes apertures 122 of the fuel outlet 80. At this point the pressure of the fuel against surface 94" and surface 96' will again be equal, and the needle 96 will continue to be urged in a closed position relative to fuel outlet 80 by spring 118.

The ratio of the flow rates for apertures 68 and 144 will determine the rate at which the needle 96 and control rod 92 will move upwardly and downwardly to open and close the fuel outlet 80 during Stage 3. The relative size of the orifices 68 and 144 will determine respective flow rates. The orifices 68 and 144 will be structured and arranged so that the flow rate of orifice 144 will always be greater than that of orifice 68 to allow fuel to flow out of pressure chamber 64 at conduit 70 faster than pressure chamber 64 can be refilled at orifice 68 when the valve member 36 of the timing control valve 32 is in an open mode. The size of orifice 68 determines the rate at which fuel will refill the pressure chamber 64, and therefore the rate at which the control rod 92 will urge the needle 96 downwardly to close the fuel outlet 80. When the injection has been ended and no further injections are desired, the pressurization control valve (18) is opened to release the pressure in the injector. (This is done to minimize wasted power of further pressurization as the plunger continues to the bottom of its stroke). At the completion of Stage 3 illustrated in FIG. 4, the high point 156 of cam 108 will be in engagement with the cam follower 112, the plunger 104 will have reached its maximum downward stroke and the needle tip will close apertures 122.

Stage 4 (FIG. 1)

As the cam 108 continues to rotate in direction 154, the spring 114 will urge the cam follower 112 and plunger 104 upwardly as the cam rotates towards engagement of the low point 152 with the top of the cam follower 112. During such rotation, in response to signals from the electronic control module, the valve assembly 32 will remain in a closed mode, and the valve member 18 will remain open so that the pressurized fuel will bleed out of the body of the injector. The fuel injector assembly 10 will then repeat the cycles of Stages 1 and 2 until the pressurization/injection cycle of Stage 3 is called for.

In the operation of the fuel injector assembly of the present invention, the delay between closing the pressurization control valve 12 and subsequently opening the timing control valve 32 will determine the initial injection pressure. For example, a longer delay time will increase the initial injection pressure and a shorter delay time will reduce the initial injection pressure. The structure and arrangement of the plunger 104 and the cam 108 will control the rate of pressure rise before and during injection of the fuel as in current unit injector and pump-line-nozzle systems. Due to the fact that the stroke of the plunger 104 is limited, the cam 108 can be designed such that it actuates the plunger slowly. If desired, the cam profile and plunger diameter can be designed such that the injection pressure will only slightly increase at low engine speeds. For example, it is possible to increase the injection pressure 50 p.s.i. per 10 crank degrees while operating at 600 r.p.m. Such a feature allows substantial flexibility in injection pressures and timings for a fixed plunger stroke or cam lift over the entire speed range of the engine. This is very different from current injection strategies where the trend is to drive up injection pressure as fast as possible.

Figure 5:
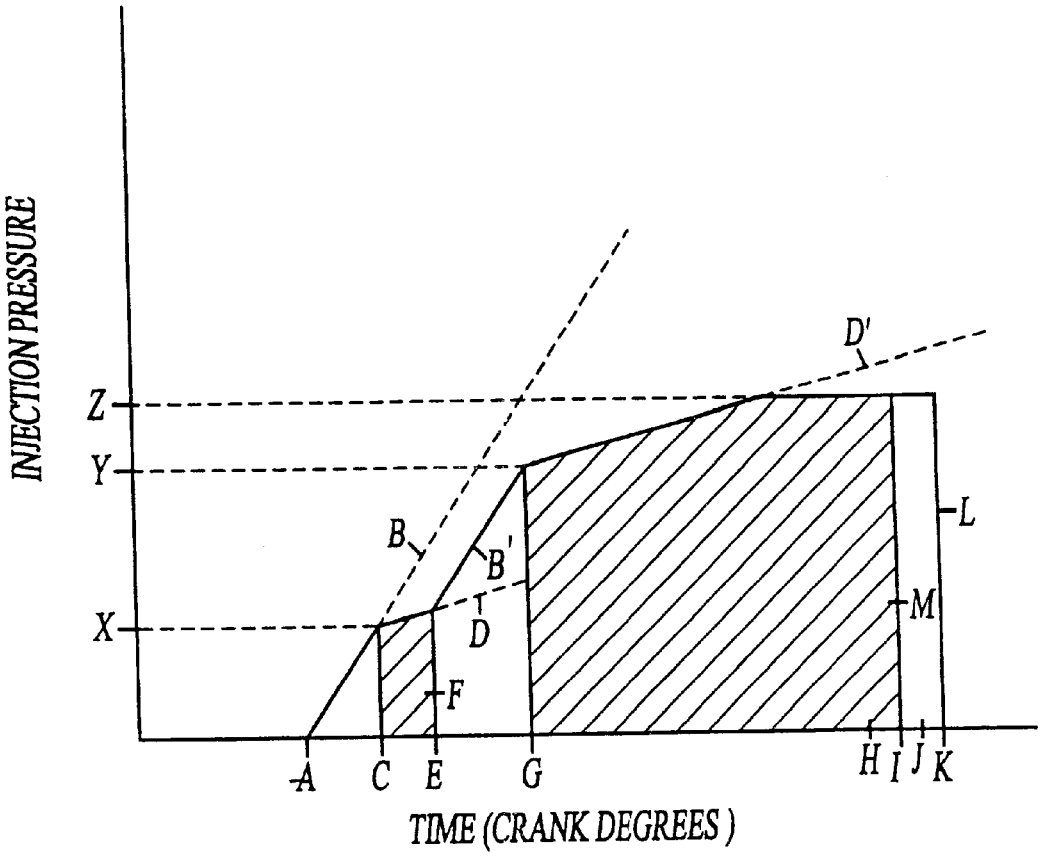
FIG. 5 is illustrative of the sequential operation of one embodiment of a fuel injector assembly of the present invention.

In the operation of the embodiment discussed above, the pressurization control valve assembly 12 and the timing control valve assembly 32 are cycled only once per engine pressurization cycle so that the needle 96 is actuated and fuel is injected only once per engine pressurization cycle. In particular, valve assembly 12 will be cycled such that valve member 18 will be closed preceding pressurization and will be opened shortly after injection is stopped. Timing control valve assembly 32 will be cycled to open and close only to begin and end fuel injection, respectively. In an alternative embodiment, the timing control valve assembly 32 may be cycled several times by the ECM during the engine pressurization cycle so that the needle 96 will be actuated and fuel will be injected several times per engine pressurization cycle. FIG. 5 graphically illustrates such an embodiment.

FIG. 5 illustrates sequential operation of the fuel injector assembly 10 wherein the timing control valve assembly 32 is cycled twice during a single pressurization cycle including a pilot mode and a main mode. In the pilot mode, the valve assemblies 12 and 32 are closed and the needle 96 of the needle valve is held in a closed position by spring 118 at A. As the plunger 104 is moved downwardly, pressure within the injector increases. The rate of pressure rise in the injector as plunger 104 is moved downwardly is represented at B. The needle 96 will remain in a closed position due to pressure equalization in chambers 64 and 76. The timing control valve assembly 32 is then opened at C. The pressure at the beginning a pilot injection is represented at X. Opening valve assembly 32 causes the pressure in pressure chamber 64 to decrease relative to the pressure in pressure chamber 76 as the plunger 104 continues to be moved downwardly. Such a decrease in pressure will be sufficient to permit the pressure in chamber 76 bearing against the surface 96' of the needle 96 to move the needle upwardly thereby opening the apertures 122 and allowing fuel to be injected therethrough at the fuel outlet 80. The rate of pressure rise in the injector during such injection is represented at D. The timing control valve assembly 32 is then closed at E causing the pressure in pressure chamber 64 to increase relative to the pressure in pressure chamber 76 until the pressure is sufficient to urge the control rod 92 and needle 96 downwardly thereby closing the apertures 122 and preventing fuel from being injected therethrough at the fuel outlet 80. The rate of pressure rise in the injector when the needle valve is closed in this manner is represented at B'. The rate of pressure rise at B and B' is substantially identical, the needle valve being closed in each instance. The quantity of fuel injected into the combustion chamber during the pilot mode between the beginning of fuel injection at C and the end of fuel injection at E is represented by the area F.

In the main mode, as the plunger 104 continues to move downwardly, the timing control valve assembly 32 is once again opened at G. The pressure at the beginning of main injection pressure is represented at Y. Opening valve assembly 32 causes the pressure in pressure chamber 64 to again decrease relative to the pressure in pressure chamber 76. Such a decrease in pressure will be sufficient to once again permit the pressure in chamber 76 bearing against the surface 96' of the needle 96 to move the needle upwardly thereby opening the apertures 122 and allowing fuel to be injected therethrough at the fuel outlet 80. The rate of pressure rise in the injector during such injection is represented at D'. The maximum pressure reached is represented at Z. The rate of pressure rise at D and D' is substantially identical, the needle valve being open in each instance. The timing control valve assembly 32 is then closed at H causing the pressure in pressure chamber 64 to increase relative to the pressure in pressure chamber 76 until the pressure in chamber 64 is sufficient to urge the control rod 92 and needle 96 downwardly thereby closing the apertures 122 and preventing fuel from being injected therethrough at the fuel outlet 80 as represented at I. The pressurization control valve assembly 12 is then opened at J permitting the fuel to bleed out of the injector at K, the rate of pressure drop represented at L. The quantity of fuel injected in the main mode between the beginning of fuel injection at G and the end of fuel injection at I is represented by the area M.

The maximum pressure reached by the fuel injection assembly of the present invention will be a function of the pressure at the beginning of the injection into the combustion chamber, the rate of pressure rise and the duration of such injection of the fuel. When using the fuel injection assembly of the present invention, such as the fuel injection assembly 10, it is possible to realize very high pressure at the beginning of the injection into the combustion chamber. Therefore, it is desirable to provide a pressure relief mechanism to limit and regulate the maximum pressure. To this end, fuel injection assembly 10 is provided with a waste gate mechanism in the form of the collar 138. As noted above, collar 138 limits and regulates the maximum pressure to a durable level for the fuel injector assembly. The collar 138 is particularly useful in that it provides a variable orifice which regulates the peak pressure at the maximum limit. In order to accomplish this objective, the collar 138 may be fabricated in the form of a steel collar placed over the orifice 136' at fuel conduit 136. Steel collar 138 is structured and arranged so that it expands when the injection pressure reaches a predetermined undesirable limit so as to open the fuel conduit 136 at orifice 136' thereby allowing the fuel to flow to the internal spill circuit of the injector. Although a collar 138 is illustrated in FIGS. 1 to 4, other mechanical pressure relief mechanisms may be provided. For example, and without limitation, collar 138 may be replaced with a spring and needle assembly wherein the extent to which the orifice 136' is opened will vary depending upon the degree to which the needle moves into or out of such orifice in response to changes in pressure.

The use of the pressurization and timing control valve assemblies 12 and 32 as described herein to control the opening and closing of the needle valve provided by needle 96 provides many advantages. For example, it allows for the control of injection pressure at the beginning of injection, otherwise known as pop pressure, in a manner which is independent of engine speed and load. Although the end of injection pressure is still a function of engine speed and cam profile, control over beginning of injection pressure adds flexibility not present in conventional unit injectors or pump-line-nozzle systems. The present invention provides improved atomization of fuel at the beginning of injection relative to that attained using conventional unit injectors and pump-line-nozzle systems which rely upon a mechanical spring to set the pop pressure at the beginning of injection. It should be noted that the present invention may be applied to a pump-line-nozzle system if desired. The use of the valve assemblies 12 and 32 as described herein allows for varying the mean injection pressure for all engine speeds and loads.

In conventional unit injectors and pump-line-nozzle systems, it is desirable to provide an injection rate that increases as the combustion event progresses. This is desired since such an increase serves to increase the heat input rate to the engine cylinder as the cylinder volume increases with the downward stroke of the piston. Use of the fuel injector assembly of the present invention permits the injection rate shape to begin at a set level and increase as the injection pressure increases to the end of injection pressure. In the fuel injector assembly of the present invention, there is no need to reduce injection pressure, and therefore the fuel spray into the engine cylinder will have an improved atomization at the end of injection. Such improved atomization will reduce particulate emission levels compared to conventional unit injectors and pump-line-nozzle systems. In those instances when the timing control valve assembly is cycled for multiple injections during a single pressurization cycle, response during such multiple injections will be considerably faster than conventional unit injectors and pump-line-nozzle systems. This results from the fact that the fuel injector assembly of the present invention does not need to build up pressure for each individual injection event during a single engine cycle. In addition, current common rail fuel systems are limited to about 1400 bar (20,500 p.s.i.). The fuel injector assembly of the present invention will provide a higher injection pressure capability. In particular, the fuel injector assembly of the present invention will have a pressure capability of about 2070 bar (30,000 p.s.i.). Improvement in fuel economy at high engine speeds and loads relative to current common rail systems is therefore possible. Use of the control valve assemblies 12 and 32 has the advantage of reducing the time during which pressurized fuel is present at the needle tip of the needle valve relative to common rail fuel systems. This will provide a safety advantage over conventional common rail fuel systems. Since the fuel injector unit of the present invention is designed for use at an engine cylinder independent of other such fuel injector units at other cylinders, the injection event from one injector will not have an impact on the injection event of any other injector. The fuel injector assembly of the present invention is designed such that all of the high pressure components are contained as a single unit. This provides safety and durability advantages over conventional common rail fuel systems.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A fuel injector assembly, comprising:

a fuel injector housing comprising a plunger cavity and a first fuel chamber;

a pressurization control valve assembly structured and arranged for electrical connection to an electronic control module and comprising a second fuel chamber, in fluidic communication with said first fuel chamber, and further comprising a first valve member, said first valve member being operable to open and close fuel flow between said first fuel chamber and said second fuel chamber in response to electronic control module signals;

a spill circuit conduit;

a control rod housing comprising a first pressure chamber in fluidic communication with said plunger cavity, and a control rod cavity;

a timing control valve assembly structured and arranged for electrical connection to an electronic control module and comprising a second valve member, said spill circuit conduit being in fluidic communication with said timing control valve assembly;

a first fuel conduit extending between said first pressure chamber and said timing control valve assembly, said third valve member being operable to open and close fuel flow between said first fuel conduit and said spill circuit conduit in response to electronic control module signals;

a needle assembly housing comprising a second pressure chamber, a needle cavity and a fuel outlet, said needle cavity comprising a first segment adjacent said control rod cavity and a second segment in fluidic communication with said fuel outlet and said second pressure chamber;

a second fuel conduit extending between said plunger cavity and said second pressure chamber;

a plunger extending into said plunger cavity and structured and arranged for reciprocating movement within said plunger cavity;

an actuator associated with said plunger and structured and arranged for reciprocating said plunger in said plunger cavity;

a control rod extending into said control rod cavity and having a control rod segment, extending into said first segment of said needle cavity, and a control rod surface exposed to said first pressure chamber, said control rod structured and arranged for reciprocating movement within said control rod cavity;

a needle having a first end extending into said first segment of said needle cavity, said first end including a first abutment surface engaging said control rod segment, and an opposite second end extending into said second segment of said needle cavity, said second end comprising a needle portion exposed to said second pressure chamber, said needle structured and arranged for reciprocating movement within said needle cavity to open and close said fuel outlet;

a third fuel conduit extending between said plunger cavity and said first fuel chamber;

a fourth fuel conduit extending between said second fuel chamber and a fuel supply conduit; and a fifth fuel conduit extending between said first fuel chamber and said spill circuit conduit, said second valve member being operable to open and close fuel flow between said first fuel chamber and said spill circuit, when said first valve member is closed and opened, respectively.

2. The fuel injector assembly of claim 1 wherein said needle assembly housing comprises a needle tip housing and a spring cage, said spring cage being positioned between said control rod housing and said needle tip housing, said needle tip housing comprising said second segment of said needle cavity including said second pressure chamber, and said spring cage comprising said. first segment of said needle cavity, and further including a spring within said spring cage biasing said needle towards said fuel outlet.

3. The fuel injector assembly of claim 2 wherein said spring is positioned within said first segment of said needle cavity between an inner surface of said spring cage and a second abutment surface of said needle positioned between said first abutment surface and said second end of said needle.

4. The fuel injector assembly of claim 3 wherein said second fuel conduit comprises a first length, a second length and a third length, said first length extending through said control rod housing from said plunger cavity to said spring cage, said second length extending through said spring cage from said first length to said needle tip housing, and said third length extending through said needle tip housing from said second length to said second pressure chamber.

5. The fuel injector assembly of claim 1 wherein said needle assembly housing comprises a waste gate.

6. The fuel injector assembly of claim 4 wherein said needle assembly housing comprises a waste gate.

7. The fuel injector assembly of claim 6 wherein said spring cage includes an outer peripheral surface and a sixth fuel conduit extending from said second length of said second fuel conduit to said outer peripheral surface, and further wherein said waste gate comprises a collar adjacent said outer peripheral surface including said sixth fuel conduit, said collar being expandable.

8. The fuel injector assembly of claim 7 wherein said spring cage includes a seventh fuel conduit extending from said first needle segment of said needle cavity, said seventh fuel conduit in fluidic communication with said spill circuit conduit.

9. The fuel injector assembly of claim 1 wherein said first pressure chamber communicates with said plunger cavity through a first orifice extending through said control rod housing, and further including a second orifice at said timing control valve assembly between said first fuel conduit and said second valve member, said first orifice structured and arranged to provide a first fuel flow rate relative to a second fuel flow rate of said second orifice, said second fuel flow rate being greater than said first fuel flow rate.

10. The fuel injector assembly of claim 8 wherein said first pressure chamber communicates with said plunger cavity through a first orifice extending through said control rod housing, and further including a second orifice at said timing control valve assembly between said first fuel conduit and said second valve member, said first orifice structured and arranged to provide a first fuel flow rate relative to a second fuel flow rate of said second orifice, said second fuel flow rate being greater than said first fuel flow rate.

11. The fuel injector assembly of claim 1 wherein the area of said control rod surface is greater than the area of said needle portion.

12. In an internal combustion engine which includes at least one piston which reciprocates within an engine cylinder and a fuel injector assembly which is in electrical connection with an electronic control module and extends into said cylinder, wherein the improvement comprises said fuel injector assembly comprising:

a fuel injector housing comprising a plunger cavity and a first fuel chamber;

a pressurization control valve assembly electrically connected to said electronic control module and comprising a second fuel chamber in fluidic communication with said first fuel chamber, and further comprising a first valve member, said first valve member being operable to open and close fuel flow between said first fuel chamber and said second fuel chamber in response to electronic control module signals;

a spill circuit conduit;

a control rod housing comprising a first pressure chamber in fluidic communication with said plunger cavity, and a control rod cavity;

a timing control valve assembly electrically connected to said electronic control module and comprising a second valve member, said spill circuit conduit being in fluidic communication with said timing control valve assembly;

a first fuel conduit extending between said first pressure chamber and said timing control valve assembly, said third valve member being operable to open and close fuel flow between said first fuel conduit and said spill circuit conduit in response to electronic control module signals;

a needle assembly housing comprising a second pressure chamber, a needle cavity and a fuel outlet, said needle cavity comprising a first segment adjacent said control rod cavity and a second segment in fluidic communication with said fuel outlet and said second pressure chamber;

a second fuel conduit extending between said plunger cavity and said second pressure chamber;

a plunger extending into said plunger cavity and structured and arranged for reciprocating movement within said plunger cavity;

an actuator associated with said plunger and structured and arranged for reciprocating said plunger in said plunger cavity;

a control rod extending into said control rod cavity and having a control rod segment, extending into said first segment of said needle cavity, and a control rod surface exposed to said first pressure chamber, said control rod structured and arranged for reciprocating movement within said control rod cavity;

a needle having a first end extending into said first segment of said needle cavity, said first end including a first abutment surface engaging said control rod segment, and an opposite second end extending into said second segment of said needle cavity, said second end comprising a needle portion exposed to said second pressure chamber, said needle structured and arranged for reciprocating movement within said needle cavity to open and close said fuel outlet;

a third fuel conduit extending between said plunger cavity and said first fuel chamber;

a fourth fuel conduit extending between said second fuel chamber and a fuel supply conduit; and a fifth fuel conduit extending between said first fuel chamber and said spill circuit conduit, said second valve member being operable to open and close fuel flow between said first fuel chamber and said spill circuit, when said first valve member is closed and opened, respectively.

13. The internal combustion engine of claim 12 wherein said needle assembly housing comprises a needle tip housing and a spring cage, said spring cage being positioned between said control rod housing and said needle tip housing, said needle tip housing comprising said second segment of said needle cavity including said second pressure chamber, and said spring cage comprising said first segment of said needle cavity, and further including a spring within said spring cage biasing said needle towards said fuel outlet.

14. The internal combustion engine of claim 13 wherein said spring is positioned within said first segment of said needle cavity between an inner surface of said spring cage and a second abutment surface of said needle positioned between said first abutment surface and said second end of said needle.

15. The internal combustion engine of claim 14 wherein said second fuel conduit comprises a first length, a second length and a third length, said first length extending through said control rod housing from said plunger cavity to said spring cage, said second length extending through said spring cage from said first length to said needle tip housing, and said third length extending through said needle tip housing from said second length to said second pressure chamber.

16. The internal combustion engine of claim 12 wherein said needle assembly housing comprises a waste gate.

17. The internal combustion engine of claim 15 wherein said needle assembly housing comprises a waste gate.

18. The internal combustion engine of claim 17 wherein said spring cage includes an outer peripheral surface and a sixth fuel conduit extending from said second length of said second fuel conduit to said outer peripheral surface, and further wherein said waste gate comprises a collar adjacent said outer peripheral surface including said sixth fuel conduit, said collar being expandable.

19. The internal combustion engine of claim 18 wherein said spring cage includes a seventh fuel conduit extending from said first needle segment of said needle cavity, said seventh fuel conduit in fluidic communication with said spill circuit conduit.

20. The internal combustion engine of claim 12 wherein said first pressure chamber communicates with said plunger cavity through a first orifice extending through said control rod housing, and further including a second orifice at said timing control valve assembly between said first fuel conduit and said third valve member, said first orifice structured and arranged to provide a first fuel flow rate relative to a second fuel flow rate of said second orifice, said second fuel flow rate being greater than said first fuel flow rate.

21. The internal combustion engine of claim 19 wherein said first pressure chamber communicates with said plunger cavity through a first orifice extending through said control rod housing, and further including a second orifice at said timing control valve assembly between said first fuel conduit and said third valve member, said first orifice structured and arranged to provide a first fuel flow rate relative to a second fuel flow rate of said second orifice, said second fuel flow rate being greater than said first fuel flow rate.

22. The internal combustion engine of claim 12 wherein the area of said control rod surface is greater than the area of said needle portion.

* * * * *